US006538621B1

(12) United States Patent
Sievenpiper et al.

(10) Patent No.: US 6,538,621 B1
(45) Date of Patent: Mar. 25, 2003

(54) TUNABLE IMPEDANCE SURFACE

(75) Inventors: Daniel Sievenpiper, Los Angeles; Robin J. Harvey, Newbury Park; Greg Tangonan, Oxnard; Robert Y. Loo, Agoura Hills; James H. Schaffner, Chatsworth, all of CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/537,923

(22) Filed: Mar. 29, 2000

(51) Int. Cl.[7] ..... H01Q 3/40
(52) U.S. Cl. ..... 343/909; 343/700 MS
(58) Field of Search ..... 343/909, 700 MS, 343/745, 752, 756, 778, 910

(56) References Cited

U.S. PATENT DOCUMENTS

| | | | |
|---|---|---|---|
| 3,267,480 A | 8/1966 | Lerner | 343/911 |
| 3,810,183 A | 5/1974 | Krutsinger et al. | 343/708 |

(List continued on next page.)

FOREIGN PATENT DOCUMENTS

| | | |
|---|---|---|
| DE | 196 00 609 A1 | 4/1997 |
| WO | WO 98/21734 | 5/1998 |
| WO | WO 99/50929 | 10/1999 |
| WO | 99/50929 | 10/1999 |
| WO | WO 00/44012 | 7/2000 |

OTHER PUBLICATIONS

Bradley, T.W., et al., "Development of a Voltage–Variable Dielectric (VVD), Electronic Scan Antenna," *Radar 97,* Publication No. 449, pp. 383–385 (Oct. 1997).

Balanis, C., "Aperture Antennas", *Antenna Theory, Analysis, and Design,* 2nd Edition, (New York, John Wiley & Sons, 1997), Chap. 12, pp. 575–597.

Balanis, C., "Microstrip Antennas", *Antenna Theory, Analysis and Design,* 2nd Edition, (New York, John Wiley & Sons, 1997), Chap. 14, pp. 722–736.

Cognard, J., "Alignment of Nematic Liquid Crystals and Their Mixtures" *Mol. Cryst. Lig, Cryst.* Suppl. 1, 1 (1982) pp. 1–74.

Doane, J.W., et al., "Field Controlled Light Scattering from Nematic Microdroplets", *Applied Physics Letters,* vol. 48 (Jan. 1986) pp. 269–271.

Jensen, M.A., et al., "EM Interaction of Handset Antennas and a Human in Personal Communications", *Proceedings of the IEEE,* vol. 83, No. 1 (Jan. 1995) pp. 7–17.

Jensen, M.A., et al., "Performance Analysis of Antennas for Hand–held Transceivers using FDTD", *IEEE Transactions on Antennas and Propagation,* vol. 42, No. 8 (Aug. 1994) pp. 1106–1113.

Ramo, S., et al., *Fields and Waves in Communications Electronics,* 3rd Edition (New York) John Wiley & Sons, 1994) Section 9.8—9.11, pp. 476–487.

(List continued on next page.)

*Primary Examiner*—Don Wong
*Assistant Examiner*—James Clinger
(74) *Attorney, Agent, or Firm*—Ladas & Parry

(57) ABSTRACT

A tuneable impedance surface for steering and/or focusing a radio frequency beam. The tunable surface comprises a ground plane; a plurality of elements disposed a distance from the ground plane, the distance being less than a wavelength of the radio frequency beam; and a capacitor arrangement for controllably varying the capacitance of at least selected ones of adjacent elements. A method of tuning the high impedance surface allows the surface to mimic, for example, a parabolic reflector or a diffraction grating.

34 Claims, 6 Drawing Sheets

U.S. PATENT DOCUMENTS

| | | | | | |
|---|---|---|---|---|---|
| 3,961,333 | A | | 6/1976 | Purinton | 343/872 |
| 4,150,382 | A | | 4/1979 | King | 343/754 |
| 4,266,203 | A | | 5/1981 | Saudreau et al. | 333/21 |
| 4,387,377 | A | | 6/1983 | Kandler | 343/756 |
| 4,594,595 | A | | 6/1986 | Struckman | 343/770 |
| 4,749,996 | A | | 6/1988 | Tresselt | 343/700 |
| 4,782,346 | A | | 11/1988 | Sharma | 343/795 |
| 4,843,400 | A | | 6/1989 | Tsao et al. | 343/700 |
| 4,843,403 | A | | 6/1989 | Lalezari et al. | 343/767 |
| 4,853,704 | A | | 8/1989 | Diaz et al. | 343/767 |
| 4,905,014 | A | * | 2/1990 | Gonzalez | 343/909 |
| 5,021,795 | A | * | 6/1991 | Masiulis | 343/700 MS |
| 5,023,623 | A | | 6/1991 | Kreinheder et al. | 343/725 |
| 5,081,466 | A | | 1/1992 | Bitter, Jr. | 343/767 |
| 5,115,217 | A | | 5/1992 | McGrath et al. | 333/246 |
| 5,146,235 | A | | 9/1992 | Frese | 343/895 |
| 5,268,701 | A | | 12/1993 | Smith | 343/767 |
| 5,287,118 | A | | 2/1994 | Budd | 343/909 |
| 5,519,408 | A | | 5/1996 | Schnetzer | 343/767 |
| 5,525,954 | A | | 6/1996 | Komazaki et al. | 333/219 |
| 5,531,018 | A | | 7/1996 | Saia et al. | 29/622 |
| 5,534,877 | A | | 7/1996 | Sorbello et al. | 343/700 |
| 5,541,614 | A | | 7/1996 | Lam et al. | 343/792.5 |
| 5,557,291 | A | | 9/1996 | Chu et al. | 343/725 |
| 5,589,845 | A | * | 12/1996 | Yandrofski et al. | 343/909 |
| 5,611,940 | A | | 3/1997 | Zettler | 73/514.16 |
| 5,638,946 | A | | 6/1997 | Zavracky | 200/181 |
| 5,694,134 | A | | 12/1997 | Barnes | 343/700 |
| 5,721,194 | A | | 2/1998 | Yandrofski et al. | 505/210 |
| 5,874,915 | A | | 2/1999 | Lee et al. | 342/375 |
| 5,894,288 | A | | 4/1999 | Lee et al. | 343/770 |
| 5,923,303 | A | | 7/1999 | Schwengler et al. | 343/853 |
| 5,945,951 | A | | 8/1999 | Monte et al. | 343/700 |
| 5,949,382 | A | | 9/1999 | Quan | 343/767 |
| 6,005,519 | A | | 12/1999 | Burns | 343/700 |
| 6,040,803 | A | | 3/2000 | Spall | 343/700 |
| 6,054,659 | A | | 4/2000 | Lee et al. | 200/181 |
| 6,075,485 | A | | 6/2000 | Lilly et al. | 343/700 |
| 6,081,235 | A | | 6/2000 | Romanofsky et al. | 343/700 |
| 6,097,263 | A | | 8/2000 | Mueller et al. | 333/17.1 |
| 6,097,343 | A | | 8/2000 | Goetz et al. | 343/708 |
| 6,118,406 | A | | 9/2000 | Josypenko | 343/700 |
| 6,127,908 | A | | 10/2000 | Bozler et al. | 333/246 |
| 6,154,176 | A | | 11/2000 | Fathy et al. | 343/700 |
| 6,166,705 | A | | 12/2000 | Mast et al. | 343/853 |
| 6,175,337 | B1 | | 1/2001 | Jasper, Jr. et al. | 343/770 |
| 6,191,724 | B1 | | 2/2001 | McEwan | 342/21 |
| 6,246,377 | B1 | | 6/2001 | Aiello et al. | 343/770 |

OTHER PUBLICATIONS

Sievenpiper, D., et al., "High–Impedance Electromagnetic Surfaces with a Forbidden Frequency Band", *IEEE Transaction on Microwave Theory and Techniques,* vol. 47, No. 11, (Nov. 1999) pp. 2059–2074.

Sievenpiper, D., "High–Impedance Electromagnetic Surfaces", *Ph.D. Dissertation,* Dept. of Electrical Engineering, University of California, Los Angeles, CA, 1999.

Wu, S.T., et al., "High Birefringence and Wide Nematic Range Bis–tolane Liquid Crystals", *Applied Physics Letters* vol. 74, No. 5, (Jan. 1999) pp. 344–346.

* cited by examiner

TUNABLE IMPEDANCE SURFACE

STATEMENT OF GOVERNMENT INTEREST

This invention was made with government support under Contract No. N6601–99–C–8635. The government has certain rights in this invention.

TECHNICAL FIELD

This invention relates to a surface having a tunable electromagnetic impedance, and includes a conductive sheet of metal or other conductor, covered with an array of resonant elements, which determine the surface impedance as a function of resonance frequency. The surface impedance governs the reflection phase of the conductive sheet. Each resonant element is individually tunable by adjusting a variable capacitor, thereby controlling the electromagnetic impedance of the surface. By having a tunable, position-dependent impedance, this surface can be used to focus a reflected Radio Frequency (RF) beam by forming an effective Fresnel or parabolic reflector or to steer a reflected wave by forming an effective prism or grating. The tunable impedance surface can be used to steer or focus an RF beam, which is important in such fields as satellite communications, radar, and the like.

BACKGROUND OF THE INVENTION

Prior art approaches for RF beam steering generally involve using phase shifters or mechanical gimbals. With the tunable surface disclosed herein, beam steering is accomplished by variable capacitors, thus eliminating expensive phase shifters and unreliable mechanical gimbals. The variable capacitors can be controlled electronically using variable dielectrics, or tuned using devices to impart relatively small mechanical motion such as microelectromechanical (MEM) switches.

Focusing an RF beam by a flat surface has been accomplished in the prior art by using an array of nearly resonant half-wave dipoles, which are designed to have a particular reflection phase. However, if such a structure is to include a ground plane, this prior art structure must be one-quarter wavelength thick. In the present invention, the thickness of the tunable surface is much less than one-quarter wavelength. The available bandwidth is partly determined by the tunability of the small resonant elements on the surface, which are tuned by variable capacitors.

The present application is related to U.S. patent application Ser. No. 09/537,921 entitled "An End-Fire Antenna or Array on Surface with Tunable Impedance" filed Mar. 29, 2000 and to U.S. patent application Ser. No. 09/537,722 entitled "An Electronically Tunable Reflector" filed Mar. 29, 2000 the disclosures of which are hereby incorporated herein by this reference.

The prior art includes U.S. Pat. No. 4,905,014 to Daniel G. Gonzalez, Gerald E. Pollen, and Joel F. Walker, "Microwave phasing structure for electromagnetically emulating reflective surfaces and focusing elements of selected geometry." This patent describes placing antenna elements above a planar metallic reflector for phasing a reflected wave into a desired beam shape and location. It is a flat array that emulates differently shaped reflective surfaces (such as a dish antenna).

The prior art includes U.S. Pat. No. 5,541,614 to Juan F. Lam, Gregory L. Tangonan, and Richard L. Abrams, "Smart antenna system using microelectromechanically tunable dipole antennas and photonic bandgap materials". This patent shows how to use RF MEMS switches and photonic bandgap surfaces for reconfigurable dipoles.

The prior art includes RF MEMS tunable dipoles ¼ wavelength above a metallic ground plane, but this approach results in limited bandwidth and limited tunability. We improve on this approach by replacing the reconfigurable dipole array with a tunable impedance surface, resulting in a thinner structure, with broader bandwidth.

The prior art further includes a pending applications of D. Sievenpiper, E. Yablonovitch, "Circuit and Method for Eliminating Surface Currents on Metals", U.S. provisional patent application, Ser. No. 60/079,953, filed on Mar. 30, 1998.

A conventional high-impedance surface, shown in FIG. 1, consists of an array of metal top plates or elements 10 on a flat metal sheet 12. It can be fabricated using printed circuit board technology with the metal plates or elements 10 formed on a top or first surface of a printed circuit board and a solid conducting ground or back plane 12 formed on a bottom or second surface of the printed circuit board. Vertical connections are formed as metal plated vias 14 in the printed circuit board, which connect the elements 10 with the underlying ground plane 12. The metal members, comprising the top plates 10 and the vias 14, are arranged in a two-dimensional lattice of cells, and can be visualized as mushroom-shaped or thumbtack-shaped members protruding from the flat metal surface 12. The thickness of the structure, which is controlled by the thickness of the printed circuit board, is much less than one wavelength for the frequencies of interest. The sizes of the elements 10 are also kept less than one wavelength for the frequencies of interest. The printed circuit board is not shown for ease of illustration.

Turning to FIG. 2, the properties of this surface can be explained using an effective circuit model or cell which is assigned a surface impedance equal to that of a parallel resonant LC circuit. The use of lumped cells to describe electromagnetic structures is valid when the wavelength is much longer than the size of the individual features, as is the case here. When an electromagnetic wave interacts with the surface of FIG. 1, it causes charges to build up on the ends of the top metal plates 10. This process can be described as governed by an effective capacitance C. As the charges slosh back and forth, in response to a radio-frequency field, they flow around a long path P through the vias 14 and the bottom metal surface 12. Associated with these currents is a magnetic field, and thus an inductance L. The capacitance C is controlled by the proximity of the adjacent metal plates 10 while the inductance L is controlled by the thickness of the structure.

The structure is inductive below the resonance and capacitive above resonance. Near the resonance frequency, $$\omega = \frac{1}{\sqrt{LC}},$$

the structure exhibits high electromagnetic surface impedance.

The tangential electric field at the surface is finite, while the tangential magnetic field is zero. Thus, electromagnetic waves are reflected without the phase reversal that occurs on a flat metal sheet. In general, the reflection phase can be 0, π, or anything in between, depending on the relationship between the test frequency and the resonance frequency of the structure. The reflection phase as a function of frequency, calculated using the effective medium model, is shown in FIG. 3. Far below resonance, it behaves like an ordinary metal surface, and reflects with a $\pi$ phase shift. Near resonance, where the surface impedance is high, the reflection phase crosses through zero. At higher frequencies, the phase approaches $-\pi$. The calculated model of FIG. 3 is supported by the measured reflection phase, shown for an example structure in FIG. 4.

A large number of structures of the type shown in FIG. 1 have been fabricated with a wide range of resonance frequencies, including various geometries and substrate materials. Some of the structure were designed with overlapping capacitor plates, to increase the capacitance and lower the frequency. The measured and calculated resonance frequencies for twenty three structures with various capacitance values are compared in FIG. 5. Clearly, the resonance frequency is a predictable function of the capacitance. The dotted line in FIG. 5 has a slope of unity, and indicates perfect agreement. The bars indicate the instantaneous bandwidth of the surface, defined by the frequencies where the phase is between $\pi/2$ and $-\pi/2$.

BRIEF DESCRIPTION OF THE INVENTION

Features of the present invention include:

1. A device with tunable surface impedance;
2. A method for focusing an electromagnetic wave using the tunable surface; and
3. A method for steering an electromagnetic wave using the tunable surface.

This invention provides a reconfigurable electromagnetic surface which is capable of performing a variety of functions, such as focusing or steering a beam. It improves upon the high-impedance surface, which is the subject of U.S. Provisional Patent Ser. No. 60/079,953, to include the important aspect of tunability, as well as several applications. The tunable structure can have any desired impedance, and thus any desired reflection phase. Therefore, by programming the surface impedance as a function of position, it can mimic such devices as a Fresnel reflector or a grating, and these properties can be reprogrammed electronically.

The present invention provides, in one aspect, a tuneable impedance surface for steering and/or focusing a radio frequency beam, the tunable surface comprising: a ground plane; a plurality of top plates disposed a distance from the ground plane, the distance being less than a wavelength of the radio frequency beam; and a capacitor arrangement for controllably varying the capacitance of adjacent top plates.

DETAILED DESCRIPTION

Figure 1:
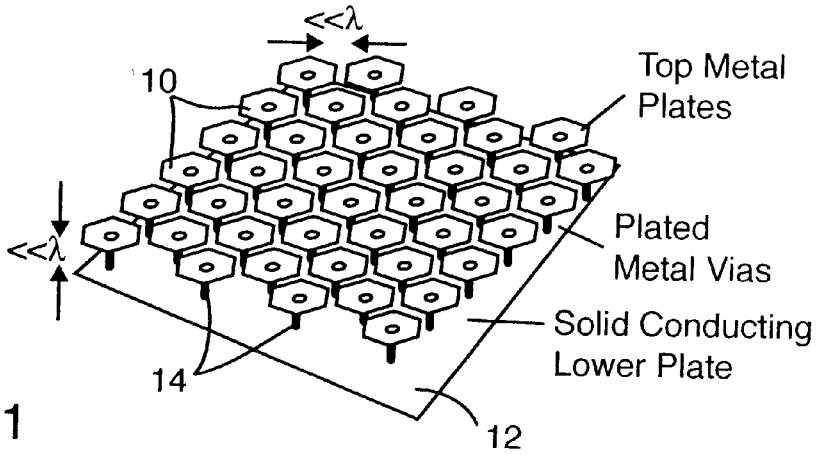
FIG. 1 depicts a conventional high-impedance surface fabricated using printed circuit board technology of the type disclosed in U.S. Provisional Patent Ser. No. 60/079,953 and having metal plates on the top side connect through metal plated vias to a solid metal ground plan on the bottom side.
Figure 2:
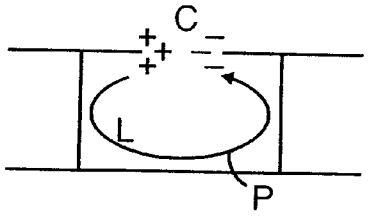
FIG. 2 is a circuit equivalent of a pair of adjacent metal top plates and associated vias.
Figure 3:
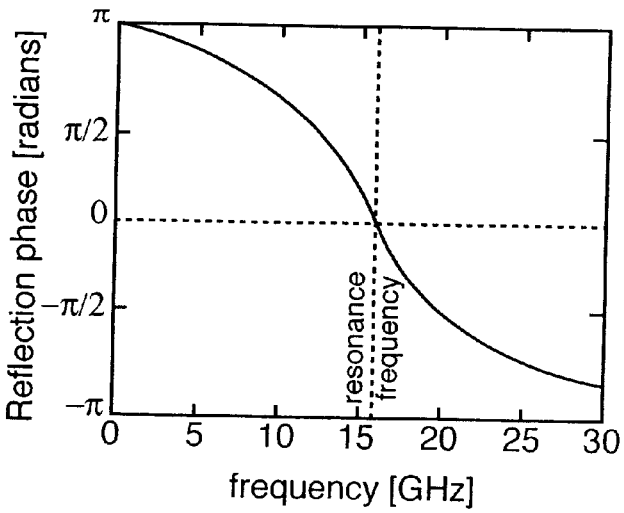
FIG. 3 depicts the calculated reflection phase of the high-impedance surface, obtained from the effective medium model and shows that the phase crosses through zero at the resonance frequency of the structure.
Figure 4:
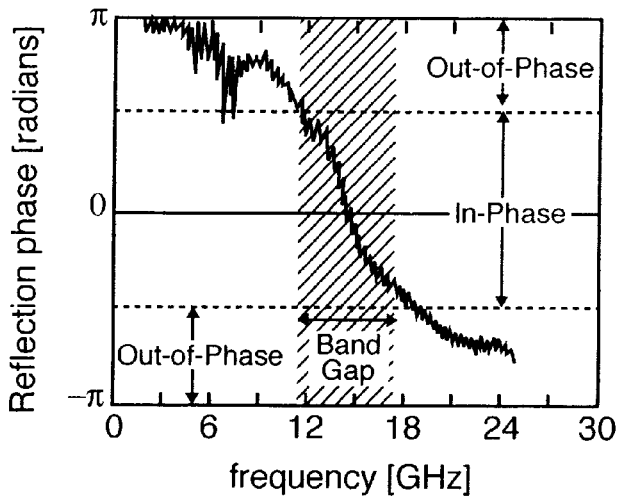
FIG. 4 shows that the measured reflection phase agrees well with the calculated reflection phase.
Figure 5:
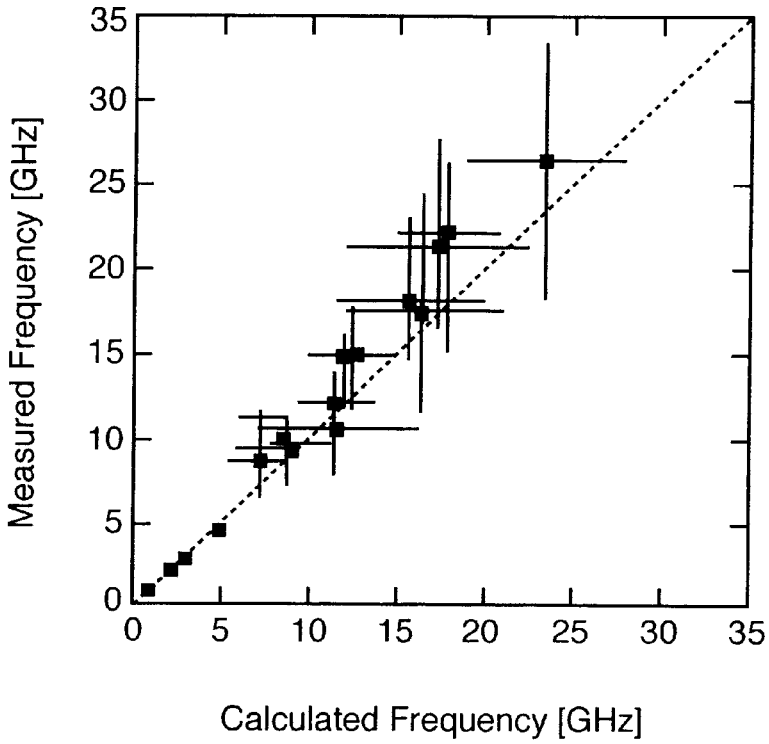
FIG. 5 depicts the measured resonance frequency compared to the calculated resonance frequency, using the effective circuit model of FIG. 2, for twenty three examples of the surface shown in FIG. 1.
Figure 6:
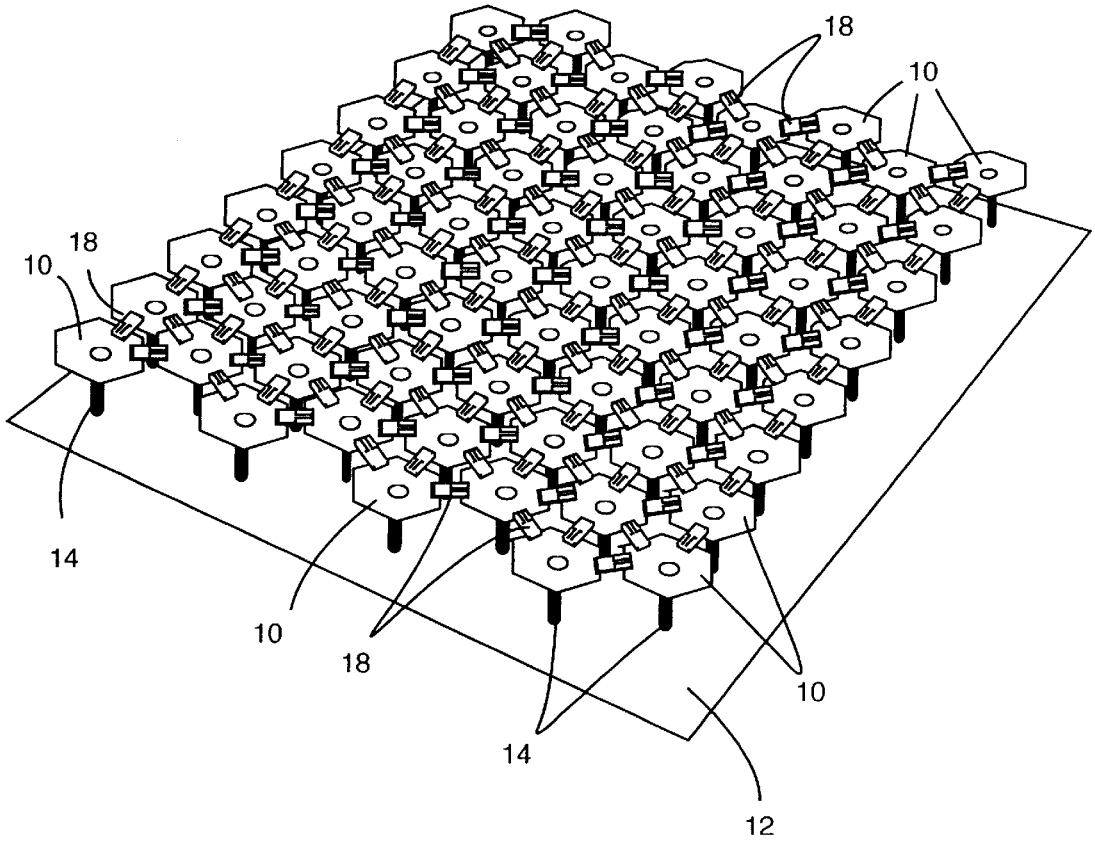
FIG. 6 depicts a high impedance surface with an array of variable capacitors placed between neighboring top plates.

In accordance with the present invention, a high-impedance surface is modified by adding variable capacitors 18 as illustrated in FIG. 6. These variable capacitors 18 can take a variety of forms, including microelectromechanical capacitors, plunger-type actuators, thermally activated bimetallic plates, or any other device for effectively varying the capacitance between a pair of capacitor plates 10. The variable capacitors 18 can alternatively be solid state devices, in which a ferroelectric or semiconductor material provides a variable capacitance controlled by an externally applied voltage. An example is shown in FIG. 6, where individual variable capacitors 18 are disposed between each neighboring pair of hexagonal metallic top plate elements 10. By changing the capacitance, the curves in FIGS. 3 and 4 are shifted according to the resonance frequency given by the relation:

$$\omega = \frac{1}{\sqrt{LC}}$$

as verified by the data depicted in FIG. 5. This has the effect of changing the impedance at a single frequency. By varying the capacitance as a function of distance along (or location on) the surface, a position-dependent or location-dependent impedance can be generated on the surface 30 (FIGS. 6 and 7), and thus a position-dependent or location-dependent reflection phase occurs. A tunable high-impedance surface 30 is thus provided.

The variable capacitors 18 can be provided by microelectromechanical capacitors, thermally activated bimetallic strips, plungers, or any other device for moving a capacitor plate. Alternatively, elements 18 could be semiconductor or ferroelectric variacs.

The capacitance C of a cell of the high impedance surface can be less than 1 pF. As such the amount of capacitance to be added to each cell to change the impedance can also be quite small and therefor the physical size of elements 18 can likewise be small. Indeed, elements 18 adding capacitance in the range of 0.1 to 1.0 pF per cell will often be quite suitable.

The tunable surface of FIG. 6 is preferably built or disposed on a substrate 24 (FIG. 7) such as a printed circuit board. The thickness of the printed circuit board is kept preferably much less than the wavelength associated with the frequency or frequency band of interest. For high frequency applications, that means than the printed circuit board is rather thin. Thin printed circuit boards having a thickness of only 0.1 mm are readily available For example, polyimide printed circuit boards are commercially available as thin as 1 mil (0.025 mm) and therefore the disclosed structure with printed circuit board technology can be used in very high frequency applications, if desired. The elements 10 are electrically conductive and typically made of a metal conveniently used in printed circuit board fabrication processes and are disposed on one surface of the substrate 24. The back plane 12 is disposed on the opposite surface of substrate 24. Vias are typically provided and plated to form conductors 14. Conductors 14 are connected to the elements 10 at one end thereof and are coupled, either capacitively or directly, as will be discussed later, at or near another end thereof to the back plane 12.

Elements 10 should be sized to be less than one half the wavelength associated with the frequency of interest. However, to minimize sidelobes, the performance of the high-impedance surface will improve as the cell size is reduced, i.e. as the physical size of the elements 10 is reduced. Preferably, the size of the elements 10 is kept to less than one tenth the wavelength associated with the frequency of interest, since that yields good results while keeping the high impedance surface reasonably manufacturable.

Figure 7:
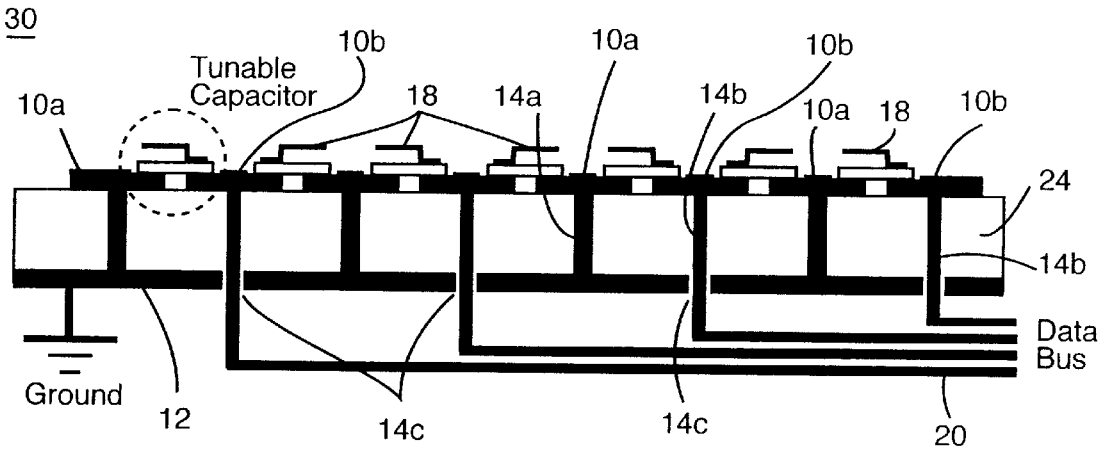
FIG. 7 depicts a circuit equivalent of the surface shown by FIG. 6, modified so that the addressing of each variable capacitor occurs by applying a voltage through an associated conducting via.

If elements 18 are provided by microelectromechanical capacitors, or by solid state variacs, the capacitance can be changed by changing an applied voltage, which can be routed through the conductive vias 14. This can be accomplished by dividing the array of elements 10 into two subsets: 10*a* and 10*b*. One subset 10*a* is electrically grounded, while the second subset 10*b* would have an applied control voltage that may be different for each element in subset 10*b*. The control voltage is applied through a via 14*b*, which in this case would not be connected to the ground plane 12, but instead to an external data bus 20. This embodiment is illustrated by FIG. 7. The data lines 20 are fed to an external control unit (not shown) for generating the desired control voltages for various beam steering or focusing operations. In this embodiment, the data lines 20 each preferably include an RF choke (not shown) wired in series to prevent radiation to the back side.

Additionally, the vias 14*b* are capacitively coupled to the ground plane 12 so that they appear to be connected to the ground plane 12 at the RF frequencies of interest, but not at the much lower frequencies of the control voltages (which would typically be considered to be comparatively slowly changing DC voltages). Since the vias 14*b* conveniently pass through the ground plane 12, they are conveniently capacitively coupled to the ground plane 12 where they penetrate the ground plane 12 and that capacitance at that point 14*c* can be conveniently controlled using techniques well known in the art. Preferably, the capacitance at the penetration point 14*c* is much larger than the capacitance of elements 18.

Figure 8:
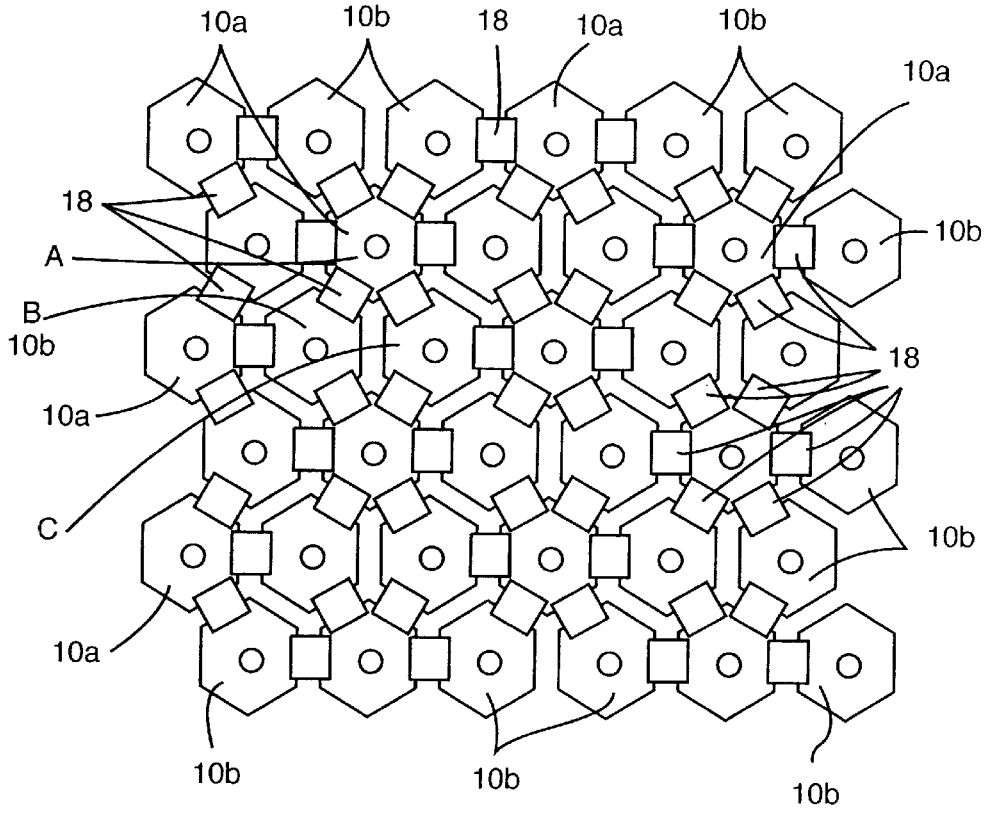
FIG. 8 depicts a top view of one embodiment of the present invention

FIG. 8 shows one embodiment of an hexagonal array of elements 10*a* and 10*b*. Recall that elements 10*a* are directly connected to the ground plane while elements 10*b* are connected to control voltages (but are capacitively or effectively coupled to the ground plane for the frequencies of the impinging RF waves of interest). The capacitances added by elements 18 are controlled by the control voltages on bus 20. Considering some particular elements 10 identified by the letters A, B, and C in FIG. 8, it will be noted that element A is directly coupled to ground since it is a member of subset 10*a*, while elements B and C have control voltages applied thereto as they both belong to subset 10*b*. The element 18 between elements A and B is controlled by the control voltage applied to element B through its associated via 14*b*. The capacitance between elements A and B is controlled by (i) their physical relationship and (ii) the capacitance contributed by the aforementioned element 18. Likewise, the element 18 between elements A and C is controlled by the control voltage applied to element C through its associated via 14*b*. However, the capacitance between elements B and C is fixed in this embodiment by their physical relationship. Of course, an element 18 could be provided between elements B and C in which case the capacitance contributed by that added element 18 would be based on the difference of the control voltages applied to elements B and C. Those skilled in the art will appreciate that such control based on voltage differences adds additional complication, since the added capacitances provided by at least some of the elements 18 are then a function of the differences in the control voltages. But if that added complication is warranted in order to provide greater control of the impedance of the surface, then even more (or perhaps all) of the elements 10 could be controlled by control voltages (in which case less or none of the elements would be directly grounded as in the case of subset 10*a*). As can be seen, the ratio of controlled (subset 10*b*) to uncontrolled (subset 10*a*) elements 10 can vary greatly.

Alternatively, all of the elements 10 can be directly connected to ground plane 12 and the control voltages from bus 20 can be connected directly to the various variable capacitors 18 through other vias (not shown), in which case no element 10 would be a controlled element of subset 10*b*.

Figure 9:
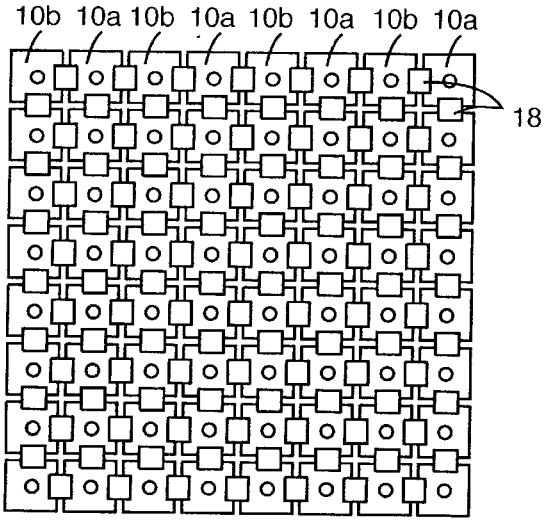
FIG. 9 depicts a top view of another embodiment of the present invention.
Figure 9A:
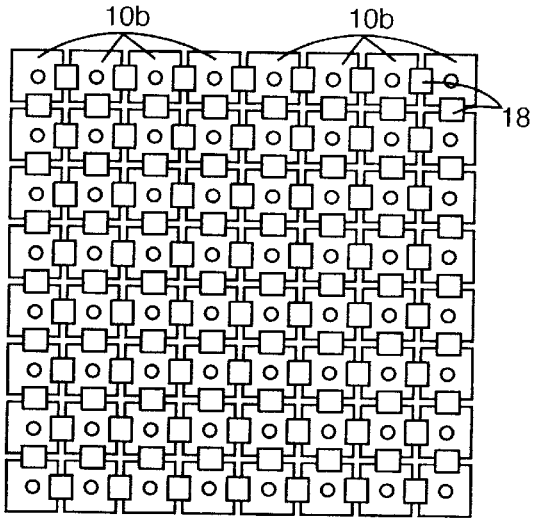
FIG. 9*a* depicts a top view of one embodiment of the present invention similar to that of FIG. 9, but with all elements being controllable.

FIG. 9 shows one embodiment of a rectangular arrangement of the elements 10*a* and 10*b*. The ratio of controlled (subset 10*b*) to uncontrolled (subset 10*a*) elements in this figure is shown as being 1:1 and an element 18 is disposed between each element 10. However, if all of the elements 18 are controlled and therefore all belong to subset 10*b* (no 10*a* elements), then the embodiment shown in FIG. 9*a* is arrived at. Again, the ratio of controlled (subset 10*b*) to uncontrolled (subset 10*a*) elements 10 can vary greatly.

Figure 10:
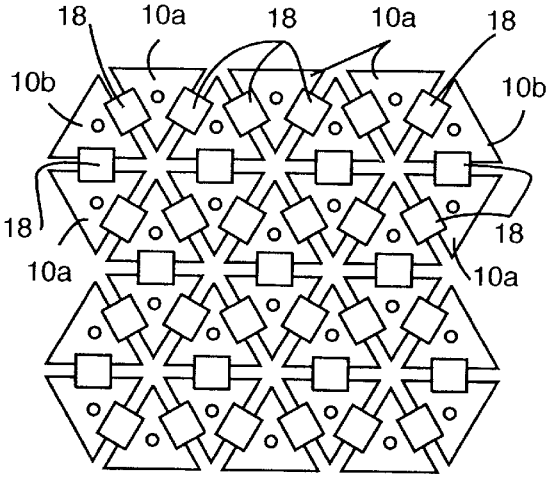
FIG. 10 depicts a top view of yet another embodiment of the present invention.
Figure 10A:
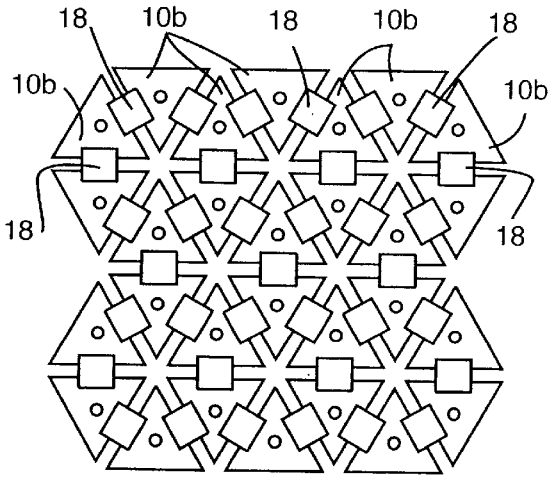
FIG. 10*a* depicts a top view of one embodiment of the present invention similar to that of FIG. 10, but with all elements being controllable.

FIG. 10 shows one embodiment of a triangular arrangement of the elements 10*a* and 10*b*. The ratio of controlled (subset 10*b*) to uncontrolled (subset 10*a*) elements in this figure is shown as being 1:1 and an element 18 is disposed by between each element 10. However, if all of the elements 18 were controlled by making them subset 10*b* elements (in which case subset 10*a* is of a zero size), then the embodiment shown in FIG. 10*a* is arrived at. As previously mentioned, the ratio of controlled (subset 10*b*) to uncontrolled (subset 10*a*) elements 10 can vary greatly.

The ratio of controlled (subset 10*b*) to uncontrolled (subset 10*a*) elements 10 can be less than 1:1, if desired, which will also have the effect of reducing the number of capacitor elements 18 utilized, but, of course, with less control of the impedance of the surface. However, that could be quite suitable in certain embodiments.

Figure 11:
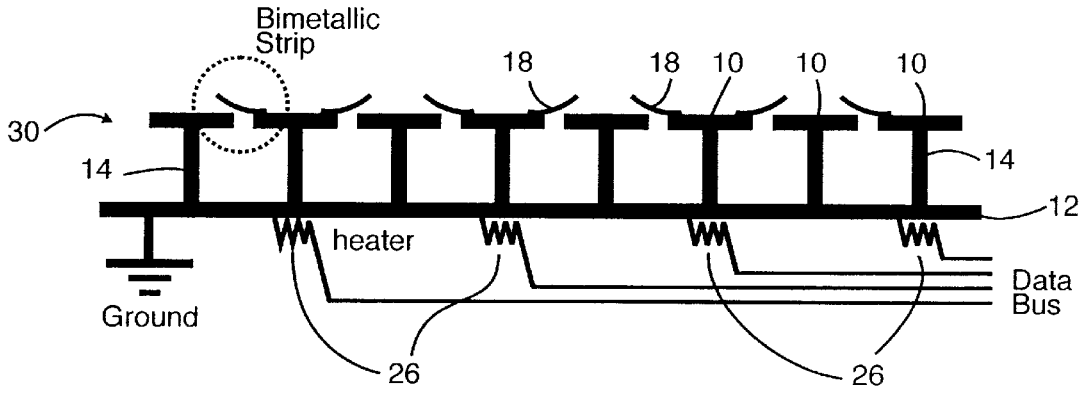
FIG. 11 depicts another technique for tuning the capacitance by using heaters arranged below the surface, which heaters causing bimetallic strips on the top surface to bend.

As an alternative method of tuning the capacitance, heaters 26 (FIG. 11) can be arranged below the surface, which would actuate an array of bimetallic strips 18, which would bend according to the local temperature. This embodiment is shown by FIG. 11 where heaters 26 are provided to control the position of the adjacent bimetallic strips 18. As the metallic strips 18 move to a close position, the capacitance increases. Another method of tuning the capacitance involves mechanical plungers, which could be moved by hydraulic pressure or by a series of magnetic coils. The examples given here are not meant to limit how additional capacitance can be added. Any available technique for tuning the capacitance may be utilized.

Figure 12:
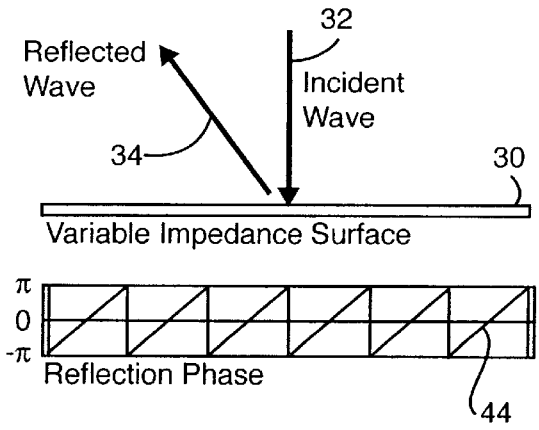
FIG. 12 demonstrates how beam can be steered by impressing a linear reflection phase function on the tunable impedance surface—phase discontinuities of $2\pi$ are used to steer to large angles, making the surface resemble a grating.

The operations that can be performed depend on the surface impedance, and thus the reflection phase, as a function of position. If the reflection phase assumes a linear slope 44, the surface can be used to steer an RF beam 32, as illustrated in FIG. 12. FIG. 12 demonstrates how incident beam 32 can be steered to produce a reflected beam 34 by impressing a linear reflection phase function 44 on the tunable impedance surface 30. To steer to large angles, phase discontinuities of $2\pi$ can be included, so the surface acts like a diffraction grating.

Figure 13:
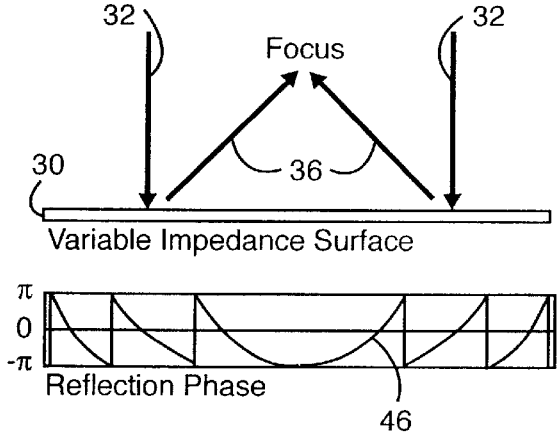
FIG. 13 demonstrates how a parabolic reflection phase function can be used to focus a beam.

Alternatively, a parabolic function 46 can be used to focus a reflected beam 36, as shown in FIG. 13. FIG. 13 demonstrates how an incident RF beam 32 can be steered by impressing a parabolic reflection phase function 46 on the tunable impedance surface 30. To steer to large angles, phase discontinuities of $2\pi$ are included, so the surface acts like a Fresnel or parabolic reflector to focus an incident wave 32.

Of course, the tunable impedance surface 30 can be easily tuned by adjusting the capacitors 18 so that the impedance of the surface 30 varies as a function of location across the surface. As can be seen by reference to FIGS. 12 and 13, changing the impedance profile on the tunable impedance surface 30 has a profound effect on how an incident RF wave 32 interacts with the surface 30.

Indeed, surface 30 can be planar and yet act as if it were a prior art parabolic dish reflector or a diffraction grating. Even more remarkable is the fact that surface 30 can be effectively programmed to mimic not only parabolic reflectors of different sizes, but also flat, angled reflectors or any other shape of reflector or diffraction grating by simply changing the impedance of the surface as a function of location on the surface.

In the embodiments shown by the drawings the tunable impedance surface 30 is depicted as being planar. However, the invention is not limited to planar tunable impedance surfaces. Indeed, those skilled in the art will appreciate the fact that the printed circuit board technology preferably used to provide a substrate 24 for the tunable impedance surface 30 can provide a very flexible substrate 24. Thus the tunable impedance surface 30 can be mounted on any convenient surface and conform to the shape of that surface. The tuning of the impedance function would then be adjusted to account for the shape of that surface. Thus, surface 30 can be planar, non-planar, convex, concave or have any other shape and still act as if it were a prior art parabolic dish reflector or as a diffraction grating by appropriately tuning its surface impedance.

The top plate elements 10 and the ground or back plane element 12 are preferably formed from a metal such as copper or a copper alloy conveniently used in printed circuit board technologies. However, non-metallic, conductive materials may be used instead of metals for the top plate elements 10 and/or the ground or back plane element 12, if desired.

Having described the invention in connection with certain embodiments thereof, modification will now certainly suggest itself to those skilled in the art. As such, the invention is not to be limited to the disclosed embodiments except as required by the appended claims.

What is claimed is:

1. A tuneable impedance surface for reflecting a radio frequency beam, the tunable surface comprising:

(a) a ground plane;

(b) a plurality of elements disposed in an array a distance from the ground plane, the distance being less than a wavelength of the radio frequency beam; and (b) a capacitor arrangement for controllably varying capacitance between at least selected ones of adjacent elements in said array.

2. The tuneable impedance surface of claim 1 further including a substrate having first and second major surfaces, said substrate supporting said ground plane on the first major surface thereof and supporting said plurality of elements on the second major surface thereof.

3. The tuneable impedance surface of claim 2 wherein said capacitor arrangement is adjustable to spatially tune the impedances of said plurality of elements.

4. The tuneable impedance surface of claim 3 wherein the plurality of elements each have an outside diameter which is less than the wavelength of the radio frequency beam.

5. The tuneable impedance surface of claim 1 wherein approximately one-half of the elements are directly or ohmically coupled to the ground plane by vias in a substrate supporting said ground plane, said plurality of elements and said capacitor arrangement.

6. The tuneable impedance surface of claim 5 wherein the elements which are not directly or ohmically coupled to the ground plane are coupled to a data bus for applying control voltages thereto.

7. The tuneable impedance surface of claim 6 wherein the elements, which are coupled to the data bus, are also capacitively coupled to the ground plane so as to appear to effectively shorted thereto for a frequency or frequencies of said radio frequency beam.

8. The tuneable impedance surface of claim 1 wherein less than one-half of the elements are directly or ohmically coupled to the ground plane.

9. The tuneable impedance surface of claim 8 wherein more than one-half of the elements are coupled to a data bus for applying control voltages thereto.

10. The tuneable impedance surface of claim 6 wherein the elements which are coupled to the data bus are capacitively coupled to the ground plane so as to appear to effectively shorted thereto for a frequency or frequencies of said radio frequency beam.

11. The tuneable impedance surface of claim 1 wherein all of the elements are coupled to a data bus for applying control voltages thereto.

12. The tuneable impedance surface of claim 11 wherein the elements are capacitively coupled to the ground plane so as to appear to effectively shorted thereto for a frequency or frequencies of said radio frequency beam.

13. The tuneable impedance surface of claim 1 wherein the capacitor arrangement includes a plurality of microelectromechanical capacitors connected between adjacent elements.

14. The tuneable impedance surface of claim 1 wherein the capacitor arrangement includes a plurality of variacs connected between adjacent elements.

15. The tuneable impedance surface of claim 1 wherein the plurality of elements are arranged in a planar array.

16. The tuneable impedance surface of claim 1 wherein the capacitor arrangement controllably varies the capacitance between all adjacent elements.

17. A method of tuning a high impedance surface for reflecting a radio frequency signal comprising:

arranging a plurality of generally spaced-apart conductive surfaces in an array disposed essentially parallel to and spaced from a conductive back plane, and varying the capacitance between at least selected ones of adjacent conductive surfaces in to thereby tune the impedance of said high impedance surface.

18. The method of claim 17 wherein said plurality of generally spaced-apart conductive surfaces are arranged on a printed circuit board.

19. The method of claim 17 wherein the step varying the capacitance between adjacent conductive surfaces in said array includes connecting microelectromechanical capacitors between said at least selected ones of adjacent conductive surfaces.

20. The method of claim 17 wherein the capacitance is varied between all adjacent elements.

21. The method of claim 17 wherein the step of varying the capacitance between at least selected ones of adjacent conductive surfaces includes applied control voltages to at least selected ones of said conductive surfaces.

22. The method of claim 17 wherein the size of each conductive surface along a major axis thereof plane is less than a wavelength of the radio frequency signal, and preferably less than one tenth of a wavelength of the radio frequency signal, and the spacing of each conductive surface from the back plane being less than a wavelength of the radio frequency signal.

23. The method of claim 17 wherein the high impedance surface is tuned so that a parabolic reflection phase function is impressed on the high impedance surface.

24. The method of claim 23 wherein the parabolic phase function has discontinuities of $2\pi$ therein.

25. The method of claim 17 wherein the high impedance surface is tuned so that a linear reflection phase function is impressed on the high impedance surface.

26. The method of claim 25 wherein the linear phase function has discontinuities of $2\pi$ therein.

27. The method of claim 17 wherein the conductive surfaces are generally planar and wherein the array is generally planar.

28. The method of claim 17 wherein the conductive surfaces are metallic and wherein the conductive back plane is metallic.

29. A tuneable impedance surface for reflecting a radio frequency beam, the tunable surface comprising:

(a) a ground plane;

(b) a plurality of elements disposed in an array a distance from the ground plane, the distance being less than a wavelength of the radio frequency beam; and (b) a capacitor arrangement for controllably varying the impedance along said array.

30. The method of claim 17 wherein the size of each conductive surface along a major axis thereof plane is than one tenth of a wavelength of the radio frequency signal and the spacing of each conductive surface from the back plane being less than a wavelength of the radio frequency signal.

31. A tunable impedance surface for reflecting a radio frequency beam impinging the surface, said tunable impedance surface comprising:

(a) a ground plane;

(b) a plurality of discreet elements disposed in a two-dimensional array a distance from the ground plane, the distance being less than a wave length of the radio frequency beam; and (c) a plurality of capacitors coupling neighboring ones of said elements in said two dimensional array for controllably varying capacitative coupling between said neighboring ones of said elements in said two-dimensional array.

32. The reflecting surface of claim 31, wherein the plurality of capacitors is provided by a plurality of microelectromechanical capacitors coupled to said neighboring ones of said elements in said two-dimensional array.

33. The surface of claim 31, wherein said plurality of elements is disposed in a two-dimensional planar array and wherein said plurality of capacitors are spatially tuned whereby the tunable surface mimics a parabolic reflector to steer a reflected wave front towards a focal point.

34. The surface of claim 31, further including a plurality of data lines penetrating said ground plane and coupled to selective ones of said elements in said two-dimensional array, other selected ones of said elements in said two-dimensional array being coupled to said ground plane, said plurality of data line adjustably controlling the capacitance of said plurality of capacitors in said two-dimensional array according to data on said data lines.

* * * * *